US006997679B2

(12) United States Patent
Beddard et al.

(10) Patent No.: US 6,997,679 B2
(45) **Date of Patent: *Feb. 14, 2006**

(54) AIRFOIL COOLING HOLES

(75) Inventors: Thomas B. Beddard, Simpsonville, SC (US); Carlos A. Collado, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 77 days.

This patent is subject to a terminal disclaimer.

(21) Appl. No.: 10/707,421

(22) Filed: Dec. 12, 2003

(65) Prior Publication Data

US 2005/0129515 A1 Jun. 16, 2005

(51) Int. Cl.
*F01D 5/18* (2006.01)

(52) U.S. Cl. ..... 416/92; 416/97 R; 415/115; 415/178

(58) Field of Classification Search ..... 415/115, 415/116, 178; 416/92, 96 R, 96 A, 97 R
See application file for complete search history.

(56) References Cited

U.S. PATENT DOCUMENTS

| | | | | |
|---|---|---|---|---|
| 5,117,626 | A * | 6/1992 | North et al. | 416/96 R |
| 5,413,463 | A * | 5/1995 | Chiu et al. | 416/96 R |
| 5,980,209 | A * | 11/1999 | Barry et al. | 416/92 |
| 6,082,963 | A | 7/2000 | Sexton et al. | |
| 6,190,120 | B1 * | 2/2001 | Thatcher et al. | 415/115 |
| 6,339,879 | B1 | 1/2002 | Wheat et al. | |
| 6,416,283 | B1 * | 7/2002 | Johnson et al. | 416/97 R |
| 6,499,950 | B1 | 12/2002 | Willett et al. | |
| 6,502,304 | B1 | 1/2003 | Rigney et al. | |
| 6,506,022 | B1 | 1/2003 | Bunker | |
| 6,539,627 | B1 * | 4/2003 | Fleck | 29/889.72 |
| 6,554,572 | B1 | 4/2003 | Rinck et al. | |
| 2001/0048878 | A1 | 12/2001 | Willett et al. | |
| 2003/0086785 | A1 | 5/2003 | Bunker et al. | |
| 2005/0047914 | A1 * | 3/2005 | Tomberg | 416/97 R |

FOREIGN PATENT DOCUMENTS

| | | | | |
|---|---|---|---|---|
| EP | 0207799 A2 * | 1/1987 | | 416/96 R |
| JP | 3-182602 A * | 8/1991 | | 416/97 R |

* cited by examiner

*Primary Examiner*—Christopher Verdier
(74) *Attorney, Agent, or Firm*—Sutherland Asbill and Brennan LLP

(57) ABSTRACT

An airfoil. The airfoil may include a first number of cooling holes and a second number of cooling holes positioned within the airfoil. The first number of cooling holes and the second number of cooling holes each may include a turbulated section and a non-turbulated section.

19 Claims, 5 Drawing Sheets

AIRFOIL COOLING HOLES

BACKGROUND OF INVENTION

The present invention relates generally to gas turbines and more particularly relates to cooling air circuits within a turbine airfoil.

Generally described, gas turbine buckets may have airfoil shaped body portions. The buckets may be connected at their inner ends to root portions and connected at their outer ends to tip portions. The buckets also may incorporate shrouds at these tip portions. Each shroud cooperates with like elements on adjacent buckets to prevent hot gas leakage past the tips. The use of the shrouds also may reduce vibrations.

The tip shrouds, however, may be subject to creep damage age due to the combination of high temperatures and centrifugally induced bending stresses. One method of cooling each bucket as a whole is to use a number of cooling holes. The cooling holes may transport cooling air through the bucket and form a thermal barrier between the bucket and the flow of hot gases.

Although cooling the buckets may reduce creep damage, the use of cooling air to cool the bucket may reduce the efficiency of the gas turbine as a whole due to the fact that this cooling air is not passing through the turbine section. The cooling air flow therefore should be at a minimum speed for the part. Likewise, the cooling holes may require optimization of the hole location, size, and style.

What is desired, therefore, is a cooling hole scheme for a turbine bucket that limits the reduction in overall system efficiency while providing adequate cooling to prevent creep. The scheme preferably also should increase part life.

SUMMARY OF INVENTION

The present invention thus provides an airfoil. The airfoil may include a first number of cooling holes and a second number of cooling holes positioned within the airfoil. The first number of cooling holes and the second number of cooling holes each may include a turbulated section and a non-turbulated section.

The first number of cooling holes may include five (5) cooling holes. The first number of cooling holes may include a first end and a second end such that the turbulated section extends from about thirty-five percent (35%) of the length from the first end to about seventy-five percent (75%) of the length. The turbulated section of the first number of cooling holes may include a first diameter, the non-turbulated section may include a second diameter, and the first diameter may be larger than the second diameter. The turbulated section may have a diameter of about 0.175 inches (about 4.45 millimeters) and the non-turbulated section may have a diameter of about 0.135 inches (about 3.43 millimeters). The turbulated section may include ribs therein. A number of non-turbulated sections may be used.

The second number of cooling holes may include two (2) cooling holes. The second number of cooling holes may include a first end and a second end such that the turbulated section extends from about fifty percent (50%) of the length from the first end to about seventy-five percent (75%) of the length. The turbulated section of the second number of cooling holes may include a first diameter, the non-turbulated section may include a second diameter, and the first diameter may be larger than the second diameter. The turbulated section may have a diameter of about 0.165 inches (about 4.19 millimeter) and the non-turbulated section may have a diameter of about 0.125 inches (about 3.18 millimeters). A number of non-turbulated sections may be used.

The airfoil further may include a third number of cooling holes positioned within the airfoil. The third number of cooling holes may include a non-turbulated section. The non-turbulated section may include a diameter of about 0.115 inches (about 2.92 millimeters). The first number of cooling holes, the second number of cooling holes, and the third number of cooling holes may include nine (9) cooling holes.

The airfoil further may include a tenth cooling hole positioned therein. The tenth cooling hole may include a diameter of about 0.08 inches (about 2.03 millimeters).

A further embodiment of the present invention may provide an airfoil for use with a turbine. The airfoil may include a first end, a middle portion, and a second end. The airfoil may include a number of cooling holes extending through the first end, the middle portion, and the second end. The cooling holes may be positioned in the first end according to the Cartesian coordinate values set forth in Table I and the cooling holes may be positioned in the middle portion according to the Cartesian coordinate values set forth in Table III. The cooling holes may be positioned in the second end according to the Cartesian coordinate values set forth in Table II. The airfoil may be a second stage airfoil.

These and other features of the present invention will become apparent upon review of the following detailed description when taken in conjunction with the drawings and the appended claims.

DETAILED DESCRIPTION

Figure 1:
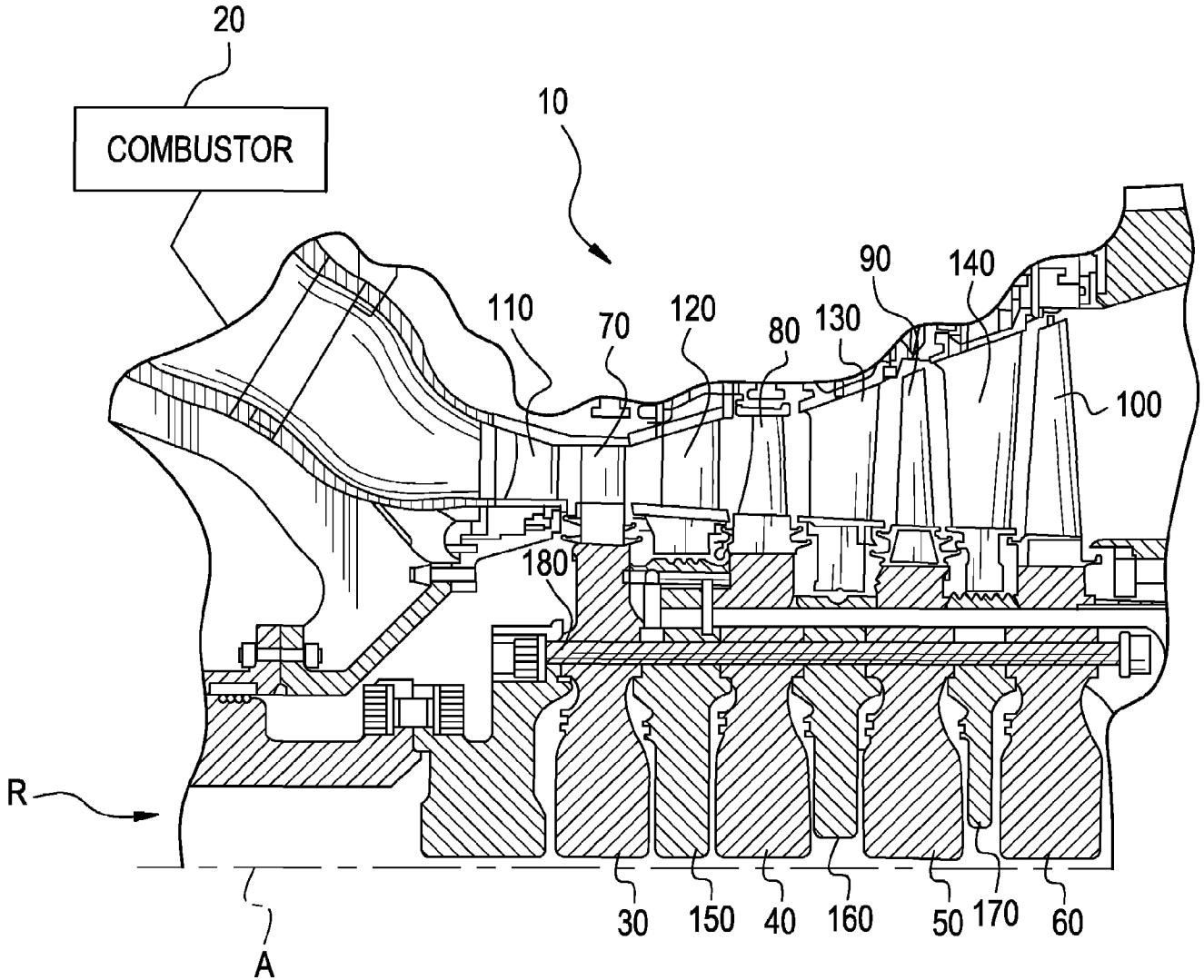
FIG. 1 is a partial side plan view of a turbine section.

Referring now to the drawings, in which like numerals refer to like elements throughout the several views, FIG. 1 shows a turbine section 10 of a gas turbine. The turbine section 10 of the gas turbine is downstream of the turbine combustor 20. The turbine section includes a rotor, generally designated R, with four successive stages. These stages include a first stage 30, a second stage 40, a third stage 50, and a fourth stage 60. Each stage includes a row of buckets, a first bucket 70, a second bucket 80, a third bucket 90, and fourth bucket 100. The blades of the buckets 70, 80, 90, 100 project radially outward into the hot combustion gas path of the turbine section 10. The buckets 70, 80, 90, 100 are arranged alternatively between fixed nozzles, a first nozzle 110, a second nozzle 120, a third nozzle 130, and a fourth nozzle 140. The stages 30, 40, 50, 60 also may be separated by a number of spacers, a first spacer 150, a second spacer 160, and a third spacer 170. The stages 30, 40, 50, 60 and the spacers 150, 160, 170 may be secured to one another by a plurality of circumferentially spaced axially extending bolts 180 (one shown).

Figure 2:
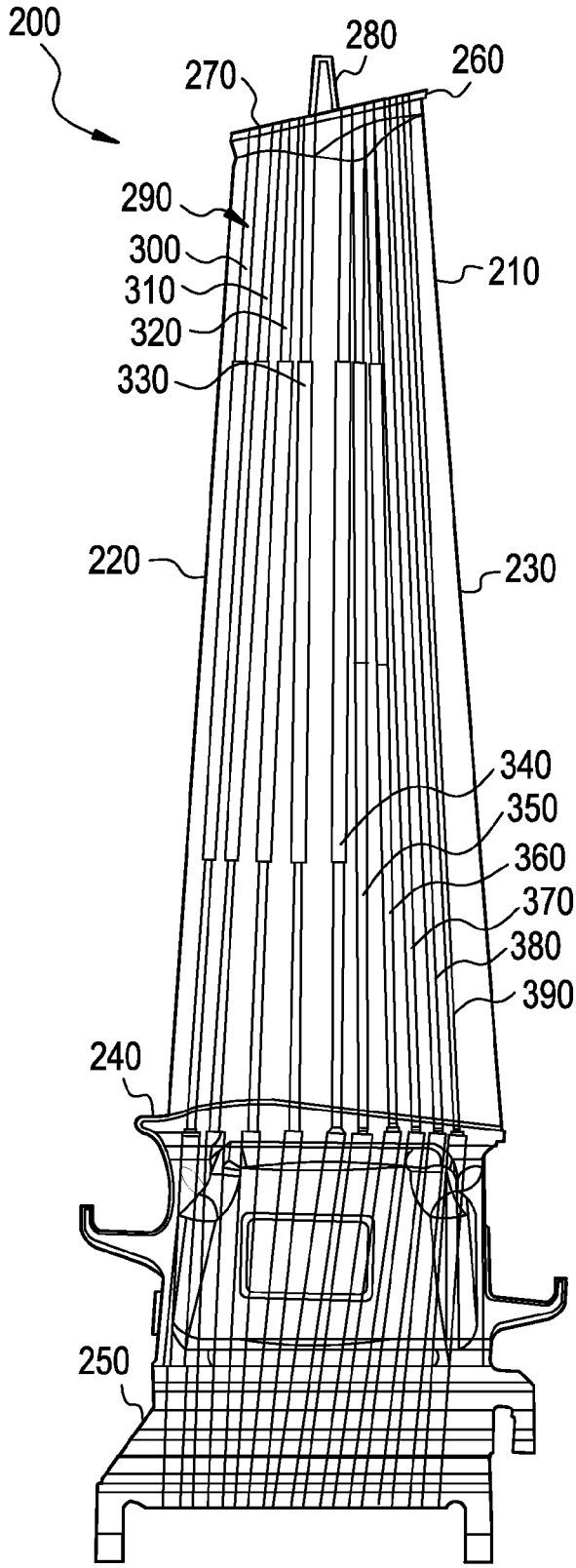
FIG. 2 is a side cross-sectional view of a bucket showing the cooling holes.
Figure 3:
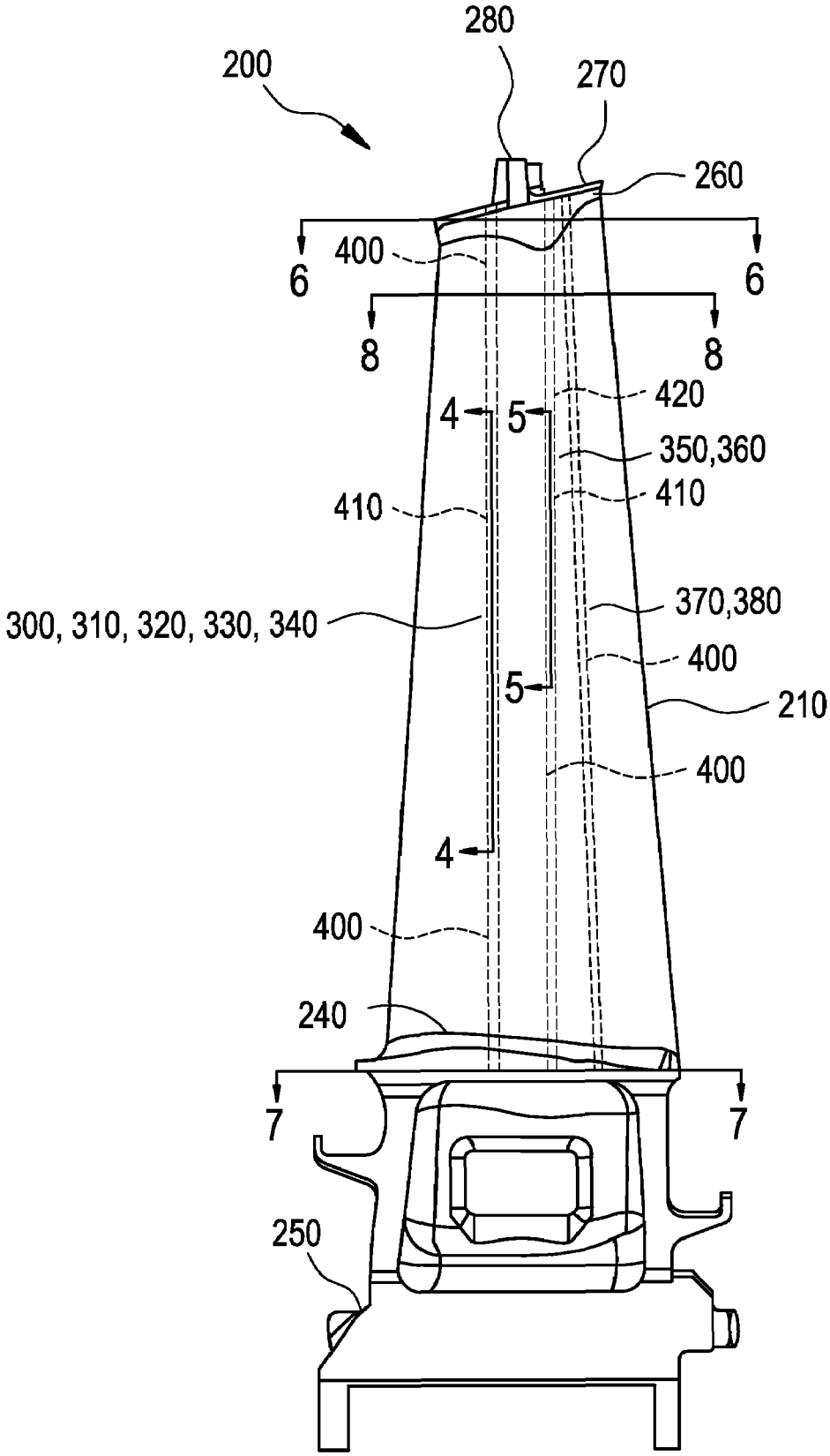
FIG. 3 is a side cross-sectional view of a bucket showing select cooling holes.

FIGS. 2 and 3 show a bucket 200 of the present invention. The bucket 200 may be the second bucket 80 on the second stage 40. Specifically, The General Electric Company of Schenectady, N.Y. may use this configuration for the second stage bucket of a turbine sold under the destination of a "9A+e" or a "7A+e" turbine. The bucket 200 may be made out of a directionally solidified alloy such as DS GTD-111™ also sold by The General Electric Company.

The bucket 200 may include a blade or an airfoil portion 210. The airfoil 210 may have a profile intended to generate aerodynamic lift. The airfoil 210 may have a leading edge 220 generally oriented upstream towards the combuster 20 and a trailing edge 230 generally oriented downstream towards the exhaust section of the turbine assembly.

One end of the airfoil 210 may extend from a blade platform 240. The blade platform 240 may define the inner radius of the hot gas flow path. The blade platform 240 also may provide a barrier between the hot gas and the inboard systems. The blade platform 240 may be connected to a blade attachment portion 250. The blade attachment portion 250 may attach the bucket 200 to the turbine shaft.

The other end of the airfoil 210 may include a tip shroud 260. The tip shroud 260 may extend beyond the edges of the airfoil 210 to form a shelf 270. The tip shroud 260 also may include a sealing rail 280 extending in the direction of the airfoil 210. The shelf 270 and the sealing rail 280 may reduce the spillover of hot gases by decreasing the size of the clearance gap and interrupting the hot gas path around the end of the bucket 200.

As is shown in FIG. 2, the bucket 200 may include a number of cooling holes 290. In this case, the bucket 200 may include ten (10) cooling holes 290, a first cooling hole 300, a second cooling hole 310, a third cooling hole 320, a fourth cooling hole 330, a fifth cooling hole 340, a sixth cooling hole 350, a seventh cooling hole 360, an eighth cooling hole 370, a ninth cooling hole 380, and a tenth hole 390. Although ten (10) cooling holes 290 are shown, any number of cooling holes 290 may be used. The cooling holes 290 may extend from the tip shroud 260, through the airfoil 210, and through the blade attachment 250.

As is shown in FIG. 3, the cooling holes 290 may be turbulated for part or all of their length. The thermal barrier formed by the cooling air stream exiting the cooling holes 290 may be improved by providing a turbulent air stream. One means of making turbulated cooling holes is shown in commonly owned U.S. Pat. No. 6,539,627, incorporated herein by reference.

Figure 4:
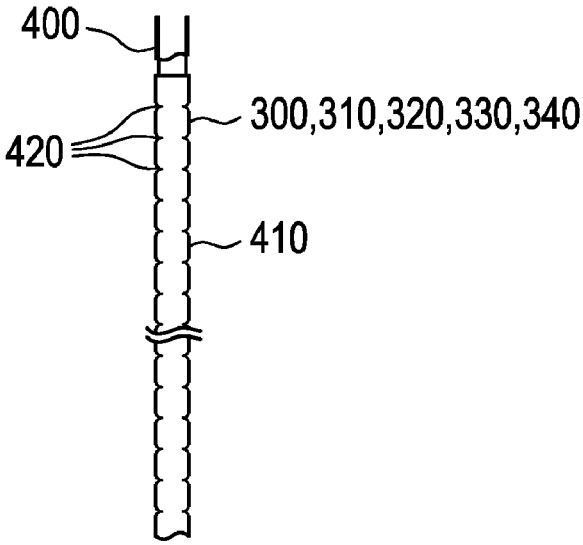
FIG. 4 is a side cross-sectional view taken along line 4—4 of FIG. 3.

For example, FIG. 3 shows one (1) of the first five (5) cooling holes 300, 310, 320, 330, 340. These cooling holes 300, 310, 320, 330, 340 may be turbulated for a portion of their length through the airfoil 210. In this example, the turbulated area may start at about thirty-five percent (35%) of the length of the airfoil 210 from the blade platform 240. The turbulated area may finish at about seventy-five percent (75%) of the airfoil 210 length. The cooling holes 300, 310, 320, 330, 340 thus may have a smooth area 400 and a turbulated area 410. The smooth area 400 may have a diameter of about 0.135 inches (about 3.43 millimeters). The turbulated area 410 may be somewhat expanded and includes a series of ribs 420 as is shown in FIG. 4. The turbulated area 410 may have a diameter of about 0.175 inches (about 4.45 millimeters). The use of the expanded area with the ribs 420 promotes turbulent airflow. As is shown, the turbulated area 410 may be positioned between two (2) smooth areas 400. Of the five (5) cooling holes 300, 310, 320, 330, 340, four (4) cooling holes may have airflow in the upstream direction and one may have airflow in the downstream direction. Any direction or combination of directions, however, may be used.

Figure 5:
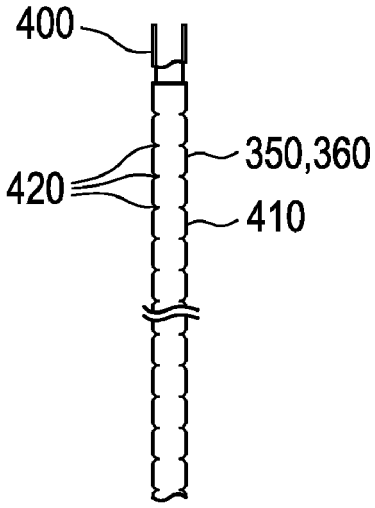
FIG. 5 is a side cross-sectional view taken along line 5—5 of FIG. 3.

Referring again to FIG. 3, cooling holes six (6) and seven (7) 350, 360 also may use the smooth areas 400 and the turbulated area 410. The turbulated area 410 may start at about fifty percent (50%) of the length of the airfoil 210 and end at about seventy-five percent (75%) of the length. The smooth areas 400 may have a diameter of about 0.125 inch (about 3.18 millimeters). The turbulated area 410 may have a diameter of about 0.165 inches (about 4.19 millimeter). The turbulated area 410 may include the ribs 420 as is shown in FIG. 5. The cooling holes six (6) and seven (7) 350, 360 may direct the air in the downstream direction.

Cooling holes eight (8) and nine (9) 370, 380 may have a smooth area 400 throughout. These cooling holes 370, 380 may have a diameter of about 0.115 inches (about 2.92 millimeters) and may have a flow in the downstream direction. The tenth (10th) cooling hole 390 also may have a smooth area 400 throughout its length. The tenth (10th) cooling hole 390 may have a diameter of about 0.08 inches (about 2.03 millimeters) and may have a flow in the downstream direction.

Figure 6:
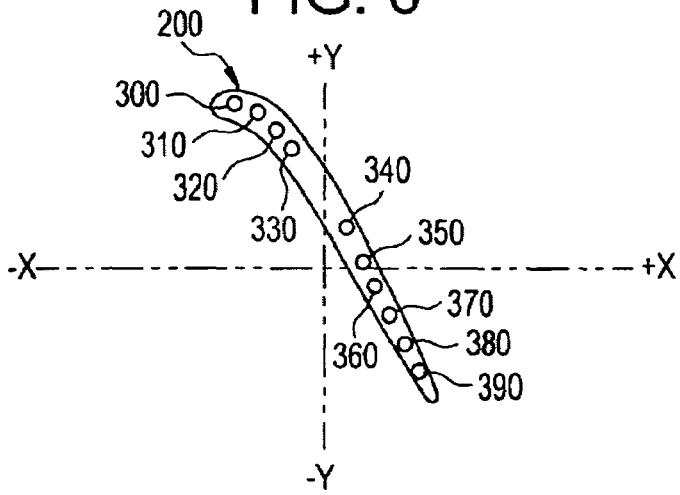
FIG. 6 is a top cross-sectional view of the bucket taken along line 6—6 of FIG. 3.
Figure 7:
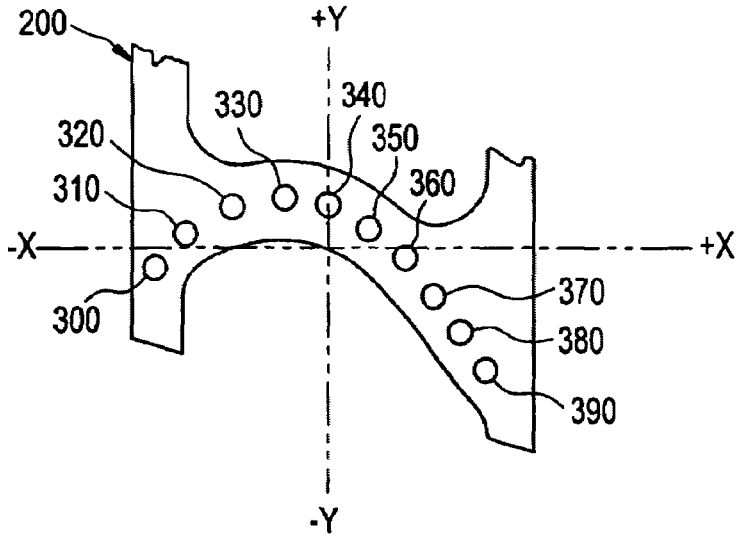
FIG. 7 is a top cross-sectional view of the bucket taken along line 7—7 of FIG. 3.
Figure 8:
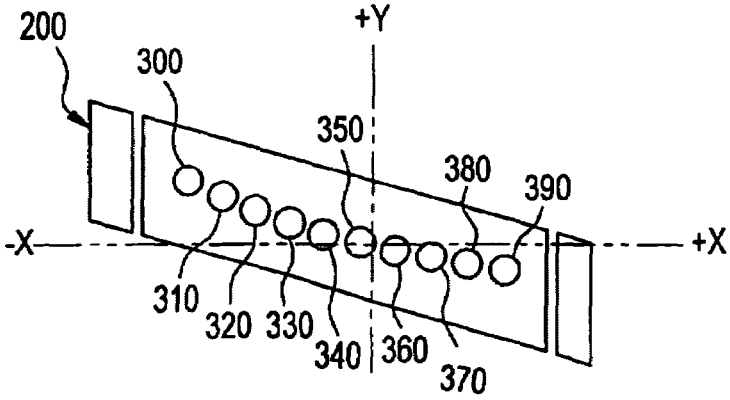
FIG. 8 is a top cross-sectional view of the bucket taken along line 8—8 of FIG. 3.

FIGS. 6–8 show the location and the configuration of the cooling holes 290 as they extend through the bucket 200. FIG. 6 shows the location of the cooling holes 290 along line 6—6 of FIG. 3. FIG. 7 shows the location of the cooling holes 290 along line 7—7 of FIG. 3. FIG. 8 shows the location of the cooling holes 290 along line 8—8 of FIG. 3. Each of the figures described above has an X and a Y axis super-imposed thereon. The following chart shows the coordinates for each of the cooling holes 290:

TABLE I

Section 6-6:

| | "X" | "Y" |
|---|---|---|
| Hole 300 | −1.561 inch (−39.65 mm) | 1.714 inch (43.54 mm) |
| Hole 310 | −1.272 inch (−32.31 mm) | 1.672 inch (42.47 mm) |
| Hole 320 | −1.008 inch (−25.60 mm) | 1.543 inch (39.19 mm) |
| Hole 330 | −0.794 inch (−19.91 mm) | 1.377 inch (34.98 mm) |
| Hole 340 | 0.167 inch (4.24 mm) | 0.627 inch (15.93 mm) |
| Hole 350 | 0.395 inch (10.03 mm) | 0.347 inch (8.81 mm) |
| Hole 360 | 0.604 inch (15.34 mm) | 0.099 inch (2.51 mm) |
| Hole 370 | 0.858 inch (21.79 mm) | −0.174 inch (−4.42 mm) |
| Hole 380 | 1.115 inch (28.32 mm) | −0.445 inch (−11.30 mm) |
| Hole 390 | 1.378 inch (35.00 mm) | −0.720 inch (−18.29 mm) |

TABLE II

Section 7-7:

| Hole | "X" | "Y" |
|---|---|---|
| Hole 300 | −1.810 inch (−45.97 mm) | −0.872 inch (−22.1597 mm) |
| Hole 310 | −1.601 inch (−40.6697 mm) | −0.319 inch (−8.1097 mm) |
| Hole 320 | −1.170 inch (−29.7297 mm) | 0.166 inch (4.2297 mm) |
| Hole 330 | −0.618 inch (−15.7097 mm) | 0.476 inch (12.0997 mm) |
| Hole 340 | −0.017 inch (−0.4397 mm) | 0.555 inch (14.1097 mm) |
| Hole 350 | 0.431 inch (10.9597 mm) | 0.382 inch (9.7097 mm) |
| Hole 360 | 0.960 inch (24.3897 mm) | 0.153 inch (3.89097 mm) |
| Hole 370 | 1.412 inch (35.8697 mm) | −0.227 inch (−5.7797 mm) |
| Hole 380 | 1.826 inch (46.3897 mm) | −0.585 inch (−14.8697 mm) |
| Hole 390 | 2.224 inch (56.4997 mm) | 0.955 inch (24.2697 mm) |

TABLE III

| Hole | "X" | "Y" |
|---|---|---|
| | Section 8-8: | |
| Hole 300 | −2.209 inch (56.11 mm) | 0.710 inch (18.03 mm) |
| Hole 310 | −1.783 inch (−45.29 mm) | 0.530 inch (13.46 mm) |
| Hole 320 | −1.377 inch (−34.98 mm) | 0.363 inch (9.23 mm) |
| Hole 330 | −0.979 inch (−24.86 mm) | 0.218 inch (5.55 mm) |
| Hole 340 | −0.579 inch (−3.971 mm) | 0.099 inch (2.51 mm) |
| Hole 350 | −0.156 inch (−3.97 mm) | 0.001 inch (0.02 mm) |
| Hole 360 | 0.260 inch (6.601 mm) | −0.089 inch (−2.27 mm) |
| Hole 370 | 0.688 inch (17.48 mm) | −0.166 inch (−4.21 mm) |
| Hole 380 | 1.120 inch (28.45 mm) | −0.245 inch (−6.23 mm) |
| Hole 390 | 1.554 inch (39.46 mm) | −0.324 inch (−8.24 mm) |

The positioning of the cooling holes 290 as described above provides superior cooling based upon the number of cooling holes 290 and their respective size, shape, style, and location. The size of the cooling holes 290 may limit the amount of airflow based on the pressure difference across the bucket 200. The location of the cooling holes 290 may determine the temperature of every finite element making up the bucket 200. The style of the cooling holes 290 may reflect the way in which heat transfer occurs across the walls of each cooling hole 290. All these attributes together may create the cooling scheme provided herein.

For example, the present invention may provide a flow of about 1.11% W2 as compared to existing designs with a flow of about 1.31% W2, or an increase of about twenty percent (20%). Generally described, W2 is a measure of the mass flow rate of air traveling through the core of the turbine that enters into the compressor. Further, the bulk creep part life may be increased to about 48,000 hours. The overall unit performance may increase by about 0.3%.

It should be understood that the foregoing relates only to the preferred embodiments of the present invention and that numerous changes may be made herein without departing from the general spirit and scope of the invention as defined by the following claims and the equivalents thereof.

We claim:

1. An airfoil, comprising:

a first plurality of cooling holes positioned within the airfoil;

said first plurality of cooling holes comprising a turbulated section and a non-turbulated section; and a second plurality of cooling holes positioned within the airfoil;

said second plurality of cooling holes comprising a turbulated section and a non-turbulated section;

wherein said turbulated section of said first plurality of cooling holes comprises a first length, said turbulated section of said second plurality of cooling holes comprises a second length; and wherein said first length is different from said second length;

wherein said first plurality of cooling holes comprises a first end and a second end and wherein said turbulated section extends from about thirty-five percent (35%) of the length of said first plurality of cooling holes from said first end to about seventy-five percent (75%) of the length of said first plurality of cooling holes from said first end.

2. The airfoil of claim 1, wherein said first plurality of cooling holes comprises five (5) cooling holes.

3. The airfoil of claim 1, wherein said turbulated section of said first plurality of cooling holes comprises a first diameter, wherein said non-turbulated section of said first plurality of cooling holes comprises a second diameter, and wherein said first diameter is larger than said second diameter.

4. The airfoil of claim 3, wherein said turbulated section of said first plurality of cooling holes comprises a diameter of about 0.175 inches and said non-turbulated section of said first plurality of cooling holes comprises a diameter of about 0.135 inches.

5. The airfoil of claim 1, wherein said turbulated section of said first plurality of cooling holes comprises ribs therein.

6. The airfoil of claim 1, wherein said non-turbulated section of said first plurality of cooling holes comprises a plurality of non-turbulated sections.

7. The airfoil of claim 1, wherein said second plurality of cooling holes comprises two (2) cooling holes.

8. The airfoil of claim 1, wherein said second plurality of cooling holes comprises a first end and a second end and wherein said turbulated section extends from about fifty percent (50%) of the length of said second plurality of cooling holes from said first end to about seventy-five percent (75%) of the length of said second plurality of cooling holes from said first end.

9. The airfoil of claim 1, wherein said turbulated section of said second plurality of cooling holes comprises a first diameter, wherein said non-turbulated section of said second plurality of cooling holes comprises a second diameter, and wherein said first diameter is larger than said second diameter.

10. The airfoil of claim 9, wherein said turbulated section of said second plurality of cooling holes comprises a diameter of about 0.165 inches and said non-turbulated section of said second plurality of cooling holes comprises a diameter of about 0.125 inches.

11. The airfoil of claim 1, wherein said non-turbulated section of said second plurality of cooling holes comprises a plurality of non-turbulated sections.

12. The airfoil of claim 1, further comprising a third plurality of cooling holes positioned within the airfoil, said third plurality comprising a non-turbulated section.

13. The airfoil of claim 12, wherein said non-turbulated section of said third plurality of cooling holes comprises a diameter of about 0.115 inches.

14. The airfoil of claim 12, wherein said first plurality of cooling holes, said second plurality of cooling holes, and said third plurality of cooling holes comprise nine (9) cooling holes.

15. The airfoil of claim 14, further comprising a tenth cooling hole positioned therein.

16. The airfoil of claim 15, wherein said tenth cooling hole comprises a diameter of about 0.08 inches.

17. An airfoil for use with a turbine, comprising:

a first end;

a middle portion;

a second end; and a plurality of cooling holes extending through said first end, said middle portion, and said second end;

said plurality of cooling holes positioned in said first end according to the Cartesian coordinate values set forth in Table I; and said plurality of cooling holes positioned in said middle portion according to the Cartesian coordinate values set forth in Table III.

18. The airfoil of claim 17, wherein said plurality of cooling holes are positioned in said second end according to the Cartesian coordinate values set forth in Table II.

19. The airfoil of claim 17, wherein said airfoil comprises a second stage airfoil.

* * * * *